United States Patent [19]

Deutsch et al.

[11] Patent Number: 4,722,259

[45] Date of Patent: Feb. 2, 1988

[54] KEYSWITCH ACTUATION DETECTOR FOR AN ELECTRONIC MUSICAL INSTRUMENT

[75] Inventors: Ralph Deutsch, Sherman Oaks; Leslie J. Deutsch, Sepulveda, both of Calif.

[73] Assignee: Kawai Musical Instruments Mfg. Co., Ltd., Hamamatsu, Japan

[21] Appl. No.: 846,384

[22] Filed: Mar. 31, 1986

[51] Int. Cl.[4] ..... G10H 1/22

[52] U.S. Cl. ..... 84/1.01; 84/DIG. 2; 340/365.5

[58] Field of Search ..... 340/365 S; 84/1.01, 84/DIG. 7, DIG. 2

[56] References Cited

U.S. PATENT DOCUMENTS

| | | | |
|---|---|---|---|
| 3,610,799 | 10/1971 | Deutsch . | |
| 3,916,387 | 10/1975 | Woodrum | 364/200 |
| 4,022,098 | 5/1977 | Deutsch et al. | 84/1.03 |
| 4,079,650 | 3/1978 | Deutsch . | |
| 4,086,628 | 4/1978 | Woodrum | 364/200 |
| 4,114,496 | 9/1978 | Deutsch . | |
| 4,495,847 | 1/1985 | Deutsch et al. | 84/1.01 |

OTHER PUBLICATIONS

A. Chaturvedi, "Tree Structures", PC Tech. Journal, Feb. 1985, pp. 78-87.

*Primary Examiner*—Stanley J. Witkowski
*Assistant Examiner*—David Warren
*Attorney, Agent, or Firm*—Ralph Deutsch

[57] ABSTRACT

A keyboard operated musical instrument is disclosed in which the number of tone generators can be less than the number of keyswitches in a keyboard array of keyswitches. A binary-tree search is programmed to search subsets of the keyswitches to find keyswitches that have been actuated. The subsets are selected in an adaptive fashion which minimizes the search time required to detect and identify all the actuated keyswitches. A modular assignment subsystem is described whereby tone generators are assigned to actuated keyswitches according to a predetermined priority logic.

12 Claims, 8 Drawing Figures

KEYSWITCH ACTUATION DETECTOR FOR AN ELECTRONIC MUSICAL INSTRUMENT

BACKGROUND OF THE INVENTION

1. Field of the Invention

A hardware problem can arise in the economical implementation of a keyswitch detect means in a keyboard operated electronic musical instrument which is constructed with microelectronic circuits. This problem is one of interfacing signal leads from a large number of keyswitches to a limited number of leads that are usually available in microelectronic circuit packages.

One approach that has been employed to deal with the multiple lead interfacing problem is to use time division multiplexing of the keyswitch states. This technique is implemented by assigning a unique time slot to each keyboard switch. The state of each keyswitch is indicated by the presence or absence of a signal pulse in the time slot assigned to the switch. An advantage of time division multiplexing is that the entire status of all the instrument's keyboard switches can be transmitted on a single signal wire. A negative attribute of time division multiplexing is that the scanning, or search, time for the multiplicity of keyswitches is fixed and is independent of the number of keyswitches that have been closed, or actuated. Such a fixed scan time can be a detrimental attribute of a keyswitch detect system because the wasted time used to sequentially scan an entire array of keyswitches when only a limited small number could possibly be actuated can result in a loss or delay of a keyswitch state change detection when the musician plays very fast. A time division multiplex note detection system is described in U.S. Pat. No. 3,610,799.

A time division multiplex system for a keyboard operated electronic musical instrument is described in U.S. Pat. No. 4,022,098. In the system described in this patent provision is made for intermanual coupling. By using pulse controlled sequential connection of manual coupling and keyboard switches an economy in wiring is obtained and keys operated on one keyboard can cause tones to sound which are associated with the same or another keyboard.

A keyswitch detect and assignor system for a keyboard operated electronic musical instrument is described in U.S. Pat. No. 4,022,098. In the described system the keyboard switches are arranged in groups of P switches, with Q groups per set of switches, and S sets of switches per keying system. During a search cycle, each group of P switches is sequentially examined to detect a change in a switch state of any member since the preceding search cycle. A change in a switch state causes the system to enter into an assign node cycle during which a data word is created in memory corresponding to a newly detected switch closure, or is removed from memory corresponding to a newly detected switch opening. After an assignment of a newly detected switch closure has been completed the system returns to the search cycle.

SUMMARY OF THE INVENTION

In a keyboard operated musical instrument having an array of keyswitches and having a number of tone generators that is generally less than the number of keyswitches, a keyswitch detect system is employed which detects actuated keyswitches and assigns tone generators to these keyswitches.

A binary-tree search is implemented which efficiently and quickly determines which keyswitches have been actuated without having to test each keyswitch on an individual basis. Preselected subsets of the keyswitches are tested simultaneously. Changes in the subsets are made in a programmed manner which is adaptive to the test results. The test results for each group are encoded so that at the end of each complete search sequence all the actuated keyswitches have been assigned identification code numbers. The search sequence is not fixed in time but varies adaptively to the set of keyswitches that have been actuated.

A modular assignment logic is used to assign tone generators to the actuated keyswitches. Any number of assignors can be used without any change in the system logic or timing functions. The assignment is made on the basis of a predetermined priority logic.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward a system for detecting the change of states in a keyboard array of keyswitches and for assigning tone generators to actuated keyswitches.

Figure 1:
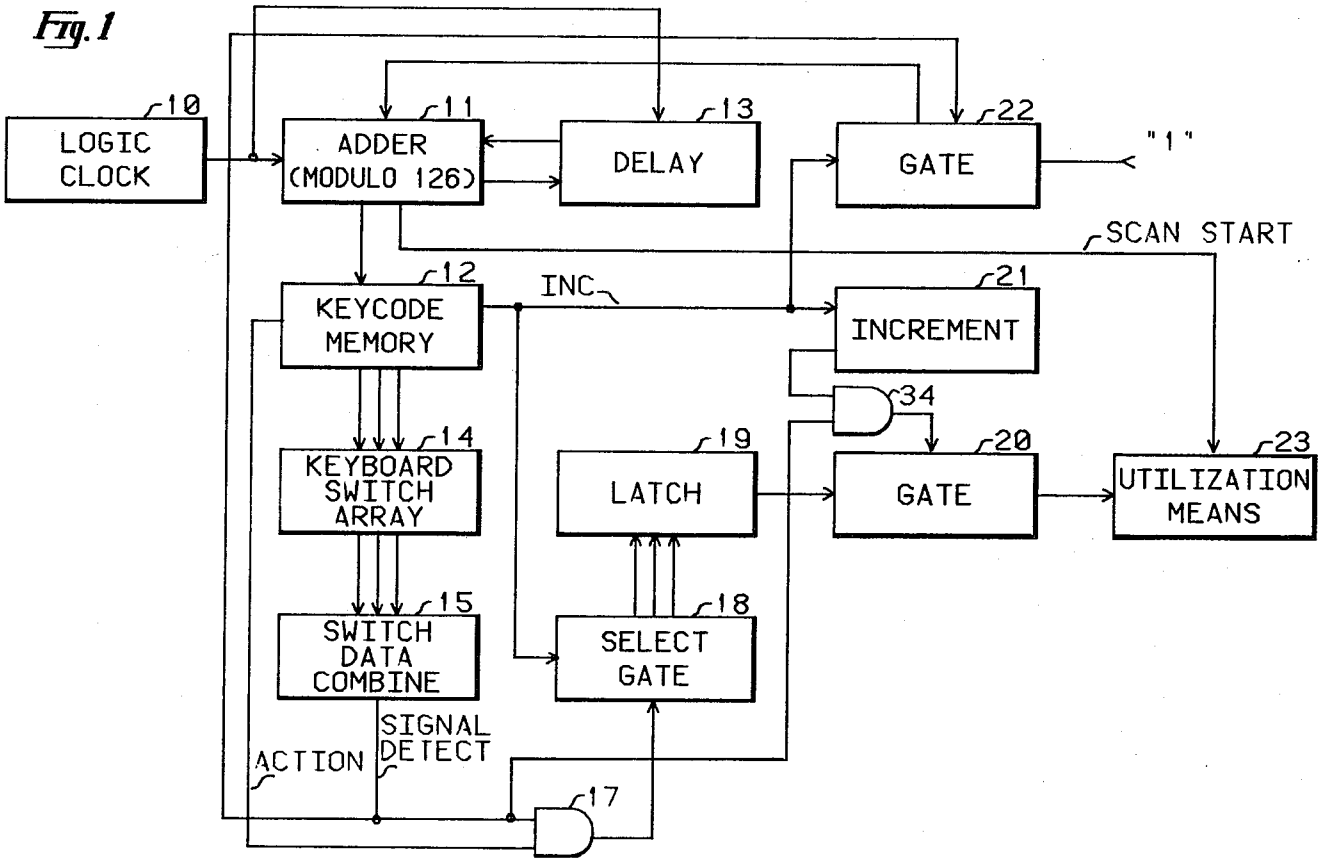
FIG. 1 is a schematic diagram of an embodiment of the invention.

FIG. 1 shows an embodiment of the present invention as incorporated into a keyboard operated electronic musical tone generator. The system searches for switch closures, or switch actuations ("on" switch state) using a search algorithm which is often referred to as a "binary-tree search." A general description of a binary-tree search algorithm is presented in the technical article: A. Chaturvedi, "Tree Structures." PC Tech Journal, February 1985, pp 78–87.

Figures 2, 3:
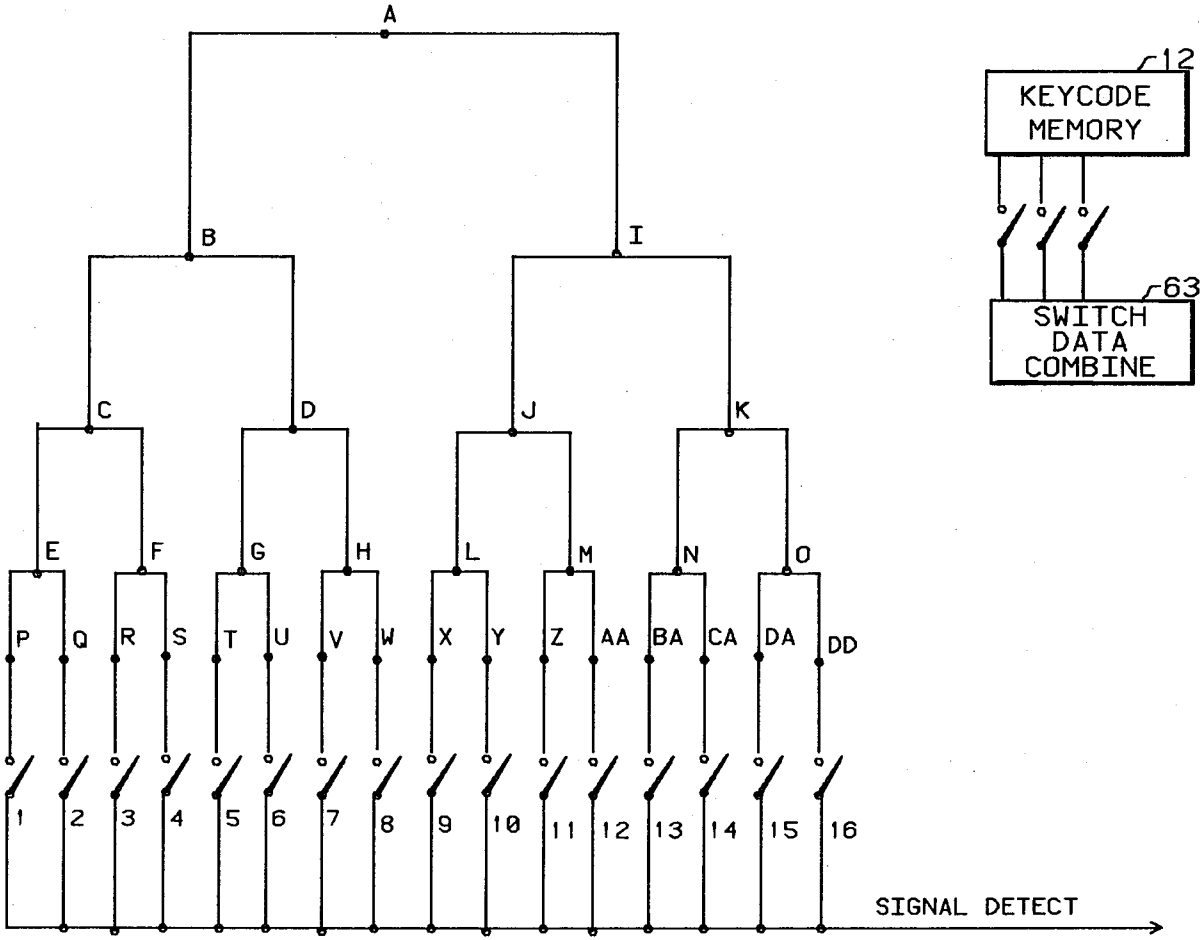
FIG. 2 is a schematic diagram of switches connected for a binary-tree search.
FIG. 3 is a schematic diagram of the keyboard switch array 14.

The general form of a binary-tree search algorithm is illustrated in FIG. 2 for a set of 16 keyswitches. The search operation starts by applying a logic "1" state signal to node B which is connected to the left half, or left 8 switches of the keyswitch array. All the output signals from the entire array of keyswitches are combined on the single signal detect line. If a "1" signal on node B causes a "1" signal on the signal detect line then at least one of the keyswitches in the left-half of the keyswitch array must be actuated (closed switch position). If a "1" signal is detected at any search state, such as the first for node B, then the search is extended to the next lower node. The left node is also chosen first when the search is extended to a lower node. The search continues in this one-half search sequence until either the search stage reaches a single keyswitch or until a "1" signal on a node produces a "0" state on the signal detect line.

For illustration, assume that in FIG. 2 switches 3 and 12 are closed and all the other switches are open. At the first step in the binary-tree search a "1" signal is transmitted from node A to node B. A "1" signal will appear on the signal detect line because switch 3 is connected to node B via nodes F and C. At the second step in the search, a "1" signal is transmitted through nodes B and C. A "1" signal will appear on the signal detect line because switch 3 is connected to node C via node F. At the third step a "1" signal is transmitted via nodes, A,B,C to node E. At the third step a "0" signal will appear on the signal detect line. The appearance of the "0" signal causes the search to return to the last successful node, which in the illustrative case is node C, and then the tree to the right of this node, node F, is selected for the next step. Therefore at the fourth step a "1" signal is transmitted to node F via nodes A,B, and C. A "1" signal will occur on the signal detect line because the actuated switch 3 is connected to the node F. Then a "1" signal is transmitted via nodes A,B,C,F and R. The appearance of a "1" signal on the signal detect line now verifies that switch 3 has been detected to be in its actuated state.

At the next step the search returns to the last successful multiple node F and then a search to the right is made by transmitting a "1" signal via nodes A,B,D,F to S. Since switch 4 is not actuated a "0" signal will appear on the signal detect line. Thus the search will again return to the last highest successful node which is node B and the next search step will investigate the network nodes to the right of B. A "1" pulse is now transmitted via nodes A,B and D. Since none of the keyswitches in the corresponding nodes are actuated, a "0" signal will appear on the signal detect line.

The search now returns to the last highest successful node which is node A and the next search step will be to investigate the network nodes to the right of node A. The next step will be to send a "1" signal to node J via nodes A and I. Since switch 12 is connected to node J a "1" signal to node L via nodes A,I, and J. A "0" signal will appear on the signal detect line. The search then returns to J which is the last successful node. The next step is to transmit a "1" signal to Node M via nodes A,I, and J. A "1" signal will appear on the signal detect line so the next step is to transmit a "1" signal to node Z via nodes A,I,J, and M. A "0" signal will appear on the signal detect line. The search returns to the last successful node M and a "1" signal is then transmitted via nodes A,I,J, and M to node AA. A "1" signal on the signal detect line now verifies that switch 12 has been detected to be in its actuated state.

At the next step the search returns to the last highest successful node I and then a search to the right is made by transmitting a "1" signal via nodes A and I to node K. A "0" signal will appear on the signal detect line because none of the keyswitches connected to node K are in their actuated state. The search now returns to node A and the entire search sequence is repeated.

To illustrate the system operation of the system shown in FIG. 1, the keyboard swithc array 14 comprises an array of 64 keyswitches. This number is chosen for illustrative purposes and does not imply a limitation or restriction for the present invention. The manner of extending the number of keyswitches will be evident from the following description.

The logic clock provides timing signals which are used to time the operation of the various system components. Adder 11 is implemented to add modulo 126 which is two less than two times the number of switches in the array of keyswitches contained in the keyboard switch array 14.

The content of the adder 11 is used to address data words out from the keycode memory 12. The data words stored in the keycode memory 12 are listed in Table 1.

Table 1

| Address | Keycode | Inc | Action |
|---|---|---|---|
| 0 | 1111111111111111111111111111111100000000000000000000000000000000 | 63 | 0 |
| 1 | 1111111111111111100000000000000000000000000000000000000000000000 | 31 | 0 |
| 2 | 1111111100000000000000000000000000000000000000000000000000000000 | 15 | 0 |
| 3 | 1111000000000000000000000000000000000000000000000000000000000000 | 7 | 0 |
| 4 | 1100000000000000000000000000000000000000000000000000000000000000 | 3 | 0 |
| 5 | 1000000000000000000000000000000000000000000000000000000000000000 | 1 | 0 |
| 6 | 0100000000000000000000000000000000000000000000000000000000000000 | 1 | 1 |
| 7 | 0011000000000000000000000000000000000000000000000000000000000000 | 3 | 1 |
| 8 | 0010000000000000000000000000000000000000000000000000000000000000 | 1 | 0 |
| 9 | 0001000000000000000000000000000000000000000000000000000000000000 | 1 | 1 |
| 10 | 0000111100000000000000000000000000000000000000000000000000000000 | 7 | 1 |
| 11 | 0000110000000000000000000000000000000000000000000000000000000000 | 3 | 0 |
| 12 | 0000100000000000000000000000000000000000000000000000000000000000 | 1 | 0 |
| 13 | 0000010000000000000000000000000000000000000000000000000000000000 | 1 | 1 |

```
14 00000011000000000000000000000000000000000000000000000000000000000000  3 1
15 00000010000000000000000000000000000000000000000000000000000000000000  1 0
16 00000001000000000000000000000000000000000000000000000000000000000000  1 1
17 00000000111111110000000000000000000000000000000000000000000000000000 15 1
18 00000000111100000000000000000000000000000000000000000000000000000000  7 0
19 00000000110000000000000000000000000000000000000000000000000000000000  3 0
20 00000000100000000000000000000000000000000000000000000000000000000000  1 0
21 00000000010000000000000000000000000000000000000000000000000000000000  1 1
22 00000000001100000000000000000000000000000000000000000000000000000000  3 1
23 00000000001000000000000000000000000000000000000000000000000000000000  1 0
24 00000000000100000000000000000000000000000000000000000000000000000000  1 1
25 00000000000011110000000000000000000000000000000000000000000000000000  7 1
26 00000000000011000000000000000000000000000000000000000000000000000000  3 0
27 00000000000010000000000000000000000000000000000000000000000000000000  1 0
28 00000000000001000000000000000000000000000000000000000000000000000000  1 1
29 00000000000000110000000000000000000000000000000000000000000000000000  3 1
30 00000000000000100000000000000000000000000000000000000000000000000000  1 0
31 00000000000000010000000000000000000000000000000000000000000000000000  1 1
32 00000000000000001111111111111111000000000000000000000000000000000000 31 1
33 00000000000000001111111100000000000000000000000000000000000000000000 15 0
34 00000000000000001111000000000000000000000000000000000000000000000000  7 0
35 00000000000000001100000000000000000000000000000000000000000000000000  3 0
36 00000000000000001000000000000000000000000000000000000000000000000000  1 0
37 00000000000000000100000000000000000000000000000000000000000000000000  1 1
38 00000000000000000110000000000000000000000000000000000000000000000000  3 1
39 00000000000000000100000000000000000000000000000000000000000000000000  1 0
40 00000000000000000010000000000000000000000000000000000000000000000000  1 1
41 00000000000000000001111000000000000000000000000000000000000000000000  7 1
42 00000000000000000001100000000000000000000000000000000000000000000000  3 0
43 00000000000000000001000000000000000000000000000000000000000000000000  1 0
44 00000000000000000000100000000000000000000000000000000000000000000000  1 1
45 00000000000000000000110000000000000000000000000000000000000000000000  3 1
46 00000000000000000000100000000000000000000000000000000000000000000000  1 0
47 00000000000000000000010000000000000000000000000000000000000000000000  1 1
48 00000000000000000000001111111100000000000000000000000000000000000000 15 1
49 00000000000000000000001111000000000000000000000000000000000000000000  7 0
50 00000000000000000000001100000000000000000000000000000000000000000000  3 0
51 00000000000000000000001000000000000000000000000000000000000000000000  1 0
```

```
52 00000000000000000000000000100000000000000000000000000000000000000000  1 1
53 00000000000000000000000000110000000000000000000000000000000000000000  3 1
54 00000000000000000000000000100000000000000000000000000000000000000000  1 0
55 00000000000000000000000000100000000000000000000000000000000000000000  1 1
56 00000000000000000000000000111100000000000000000000000000000000000000  7 1
57 00000000000000000000000000110000000000000000000000000000000000000000  3 0
58 00000000000000000000000000100000000000000000000000000000000000000000  1 0
59 00000000000000000000000000100000000000000000000000000000000000000000  1 1
60 00000000000000000000000000110000000000000000000000000000000000000000  3 1
61 00000000000000000000000000100000000000000000000000000000000000000000  1 0
62 00000000000000000000000000100000000000000000000000000000000000000000  1 1
63 00000000000000000000000000111111111111111111111111111111111111111111 62 1
64 00000000000000000000000000111111111111111110000000000000000000000000 31 0
65 00000000000000000000000000111111110000000000000000000000000000000000 15 0
66 00000000000000000000000000111100000000000000000000000000000000000000  7 0
67 00000000000000000000000000110000000000000000000000000000000000000000  3 0
68 00000000000000000000000000100000000000000000000000000000000000000000  1 0
69 00000000000000000000000000100000000000000000000000000000000000000000  1 1
70 00000000000000000000000000110000000000000000000000000000000000000000  3 1
71 00000000000000000000000000100000000000000000000000000000000000000000  1 0
72 00000000000000000000000000100000000000000000000000000000000000000000  1 1
73 00000000000000000000000000111100000000000000000000000000000000000000  7 1
74 00000000000000000000000000110000000000000000000000000000000000000000  3 0
75 00000000000000000000000000100000000000000000000000000000000000000000  1 0
76 00000000000000000000000000100000000000000000000000000000000000000000  1 1
77 00000000000000000000000000110000000000000000000000000000000000000000  3 1
78 00000000000000000000000000100000000000000000000000000000000000000000  1 0
79 00000000000000000000000000100000000000000000000000000000000000000000  1 1
80 00000000000000000000000000111111110000000000000000000000000000000000 15 1
81 00000000000000000000000000111100000000000000000000000000000000000000  7 0
82 00000000000000000000000000110000000000000000000000000000000000000000  3 0
83 00000000000000000000000000100000000000000000000000000000000000000000  1 0
84 00000000000000000000000000100000000000000000000000000000000000000000  1 1
85 00000000000000000000000000110000000000000000000000000000000000000000  3 1
86 00000000000000000000000000100000000000000000000000000000000000000000  1 0
87 00000000000000000000000000100000000000000000000000000000000000000000  1 1
88 00000000000000000000000000111100000000000000000000000000000000000000  7 1
89 00000000000000000000000000110000000000000000000000000000000000000000  3 0
90 00000000000000000000000000100000000000000000000000000000000000000000  1 0
```

| | | | |
|---|---|---|---|
| 91 | 00000000000000000000000000000000000000000000010000000000000000 | 1 | 1 |
| 92 | 00000000000000000000000000000000000000000000011000000000000000 | 3 | 1 |
| 93 | 00000000000000000000000000000000000000000000010000000000000000 | 1 | 0 |
| 94 | 00000000000000000000000000000000000000000000010000000000000000 | 1 | 1 |
| 95 | 00000000000000000000000000000000000000000000011111111111111111 | 31 | 1 |
| 96 | 00000000000000000000000000000000000000000000001111111100000000 | 15 | 0 |
| 97 | 00000000000000000000000000000000000000000000001111000000000000 | 7 | 0 |
| 98 | 00000000000000000000000000000000000000000000001100000000000000 | 3 | 0 |
| 99 | 00000000000000000000000000000000000000000000001000000000000000 | 1 | 0 |
| 100 | 00000000000000000000000000000000000000000000001000000000000000 | 1 | 1 |
| 101 | 00000000000000000000000000000000000000000000001100000000000000 | 3 | 1 |
| 102 | 00000000000000000000000000000000000000000000001000000000000000 | 1 | 0 |
| 103 | 00000000000000000000000000000000000000000000001000000000000000 | 1 | 1 |
| 104 | 00000000000000000000000000000000000000000000000111100000000000 | 7 | 1 |
| 105 | 00000000000000000000000000000000000000000000000110000000000000 | 3 | 0 |
| 106 | 00000000000000000000000000000000000000000000000100000000000000 | 1 | 0 |
| 107 | 00000000000000000000000000000000000000000000000010000000000000 | 1 | 1 |
| 108 | 00000000000000000000000000000000000000000000000011000000000000 | 3 | 1 |
| 109 | 00000000000000000000000000000000000000000000000001000000000000 | 1 | 0 |
| 110 | 00000000000000000000000000000000000000000000000000100000000000 | 1 | 1 |
| 111 | 00000000000000000000000000000000000000000000000000011111111111 | 15 | 1 |
| 112 | 00000000000000000000000000000000000000000000000000011111000000 | 7 | 0 |
| 113 | 00000000000000000000000000000000000000000000000000011000000000 | 3 | 0 |
| 114 | 00000000000000000000000000000000000000000000000000010000000000 | 1 | 0 |
| 115 | 00000000000000000000000000000000000000000000000000001000000000 | 1 | 1 |
| 116 | 00000000000000000000000000000000000000000000000000000110000000 | 3 | 1 |
| 117 | 00000000000000000000000000000000000000000000000000000100000000 | 1 | 0 |
| 118 | 00000000000000000000000000000000000000000000000000000010000000 | 1 | 1 |
| 119 | 00000000000000000000000000000000000000000000000000000001111000 | 7 | 1 |
| 120 | 00000000000000000000000000000000000000000000000000000001100000 | 3 | 0 |
| 121 | 00000000000000000000000000000000000000000000000000000001000000 | 1 | 0 |
| 122 | 00000000000000000000000000000000000000000000000000000000100000 | 1 | 1 |
| 123 | 00000000000000000000000000000000000000000000000000000000011000 | 3 | 1 |
| 124 | 00000000000000000000000000000000000000000000000000000000010000 | 1 | 0 |
| 125 | 00000000000000000000000000000000000000000000000000000000001000 | 1 | 1 |

Each bit of the keycode data word, shown in the second column of Table 1, which is read out from the keycode memory 12 is connected to an individual keyswitch contained in the keyboard switch array 14 with the LSB (least significant bit) connected to the keyswitch having the digit one as its identifying number. The MSB (most significant bit) is connected to the keyswitch having the number 64 as its identifying number. FIG. 3 illustrates the detail of the keyboard switch array 14.

The data words stored in the keycode memory 12 apply the same binary-tree search code signals to the array of keyswitches corresponding to the search nodes shown in FIG. 2. The data shown in the columns labeled Inc and Action in Table 1 are listed in their equivalent decimal form as a space saving abbreviation. In practice these data would also be stored in a binary digital format and the description will assume that these numbers are in the equivalent binary digital format.

The output signals from the keyswitches in the keyboard switch array 14 are combined onto a single signal detect line by means of the switch data combine 15. the switch data combine 15 can be implemented as a multi-input OR-gate. A simpler implementation is to use diodes or resistors in series with each switch's output line and to connect the other ends in common to the signal detect line.

For notational convenience, the keyswitches are numbered with zero for the lowest keyswitch on the keyboard. The lowest keyswitch corresponds to the lowest frequency musical tone generated the musical instrument. In Table 1, the left-most bit in keycode word corresponds to the keyswitch numbered as zero.

In response to each data word read out from the keycode memory 12 either a logic binary state of "0" or "1" will appear on the signal detect line connected to the output of the switch data combine 15. If at any stage in the search sequence a "1" signal appears on the signal detect line and the Action word for the data word read out from the keycode memory is a logic binary "0", then the AND-gate 17 transmits a "0" signal to the select gate 18. In response to the value of the Inc signal read out from the keycode memory 12 along with the Keycode data word, the select gate 18 places the binary state output from the AND-gate 17 into the latch at the bit location corresponding to the Inc signal value. The same data store will also take place if the AND-gate 17 produces a "1" logic binary state. As explained below the action of the combination of the AND-gate 18, the Inc signal, and the select gate 18 is to place a binary digital number in the latch 19 which identifies any keyswitch which is found to be in its actuated keyswitch state.

If a "1" signal appears on the signal detect line, then the gate 22 transmits a "1" logic signal to the adder 11. The delay 13 causes the adder 11 to have the previous count added to the value transmitted to it by the gate 22. Thus a "1" signal on the signal detect lines simply increments the adder 11 to its next highest count. If a "0" signal appears on the signal detect lines, then the gate 22 transmits the current value of the Inc read out of the keycode memory 12 to the adder 11.

If the Inc signal has a zero value then the increment 21 sends a binary logic "1" singal to the AND-gate 24. If at the same time the logic "1" appears on the signal detect line then the AND-gate 24 sends a "1" signal to the gate 20. In response to an input "1" signal, the gate 20 transfers the keyswitch identification code word from the latch 19 to the utilization means.

Table 2 lists the system operation steps for an illustrative situation in which only switches 3 and 41 are simultaneously closed. Each time that the adder 11 is incremented so that it returns to its initial state a SCAN START signal is generated. In a manner described below, the utilization means 23 uses the SCAN START signal for the assignment of system operations such as the assignment of the tone generators in a keyboard operated musical instrument.

TABLE 2

| Step | Adder 11 | Detect signal | Action | Inc | Latch 19 | Gate 20 |
|---|---|---|---|---|---|---|
| 1 | 0 | 1 | 0 | 63 | 0----- | N |
| 2 | 1 | 1 | 0 | 31 | 00---- | N |
| 3 | 2 | 1 | 0 | 15 | 000--- | N |
| 4 | 3 | 1 | 0 | 7 | 0000-- | N |
| 5 | 4 | 0 | 0 | 3 | 00000- | N |
| 6 | 5 | 1 | 1 | 3 | 00001- | N |
| 7 | 6 | 0 | 0 | 1 | 000010 | N |
| 8 | 9 | 1 | 1 | 1 | 000011 | Y |
| 9 | 10 | 0 | 7 | 1 | 000011 | N |
| 10 | 17 | 0 | 15 | 1 | 000011 | N |
| 11 | 32 | 0 | 31 | 1 | 000011 | N |
| 12 | 63 | 1 | 1 | 63 | 100011 | N |
| 13 | 64 | 1 | 0 | 31 | 100011 | N |
| 14 | 65 | 0 | 0 | 15 | 100011 | N |
| 15 | 80 | 1 | 1 | 15 | 101011 | N |
| 16 | 81 | 1 | 0 | 7 | 101011 | N |
| 17 | 82 | 1 | 0 | 3 | 101001 | N |
| 18 | 83 | 1 | 0 | 1 | 101001 | Y |
| 19 | 84 | 0 | 1 | 1 | 101001 | N |
| 20 | 85 | 0 | 3 | 1 | 101001 | N |
| 21 | 88 | 0 | 7 | 1 | 101001 | N |
| 22 | 95 | 0 | 1 | 31 | 101001 | N |
| 23 | 126 = 0 | 0 | 0 | 63 | 001001 | N |

An examination of the first keycode word addressed out from the keycode address for the adder 11 value of 0 is that a "1" signal will appear on the signal detect line because keyswitch 3 is actuated and it receives a logic "1" signal. Since the action value for word 0 has a "0" value, the AND-gate 17 transfers a "0" signal to the select gate 18. The select gate 18 will place a "0" in the latch 19 at the 6th bit position as directed by the current 63 value of the Inc read out from the keycode memory. Thus at this first step the latch 19 will have the keyswitch identification code word 0-----. A dash indicates that the bit state at this position can have any value such as that remaining from a previous binary tree search of a set of nodes. The N in the last column of Table 2 indicates that the gate 20 does not transfer the keyswitch identification code word to the utilization means.

In response to a "1" state on the signal detect line, the gate 22 will select a "1" signal to be sent ot the adder 11. The adder 11 in combination with the delay 13 now has the count state of 1.

The second keycode word in Table 1 is now read out of the keycode memory 12. It is noted from an examination of this word that because keyswitch 3 is actuated, a "1" state will appear on the signal detect line. Since the action now has a "0" value, the select gate 18 will place a "0" in the latch 19 at the 5th bit position as directed by the value of the Inc =31. At this stage in the search sequence, the latch 19 will contain the keyswitch identification code word of 00----.

In the manner previously described, the "1" state on the signal detect line will cause the adder 11 to be incremented to the binary state corresponding to the decimal value of 2.

The third word in Table 1 is now read out of the keycode memory 12. Again a "1" will appear on the signal detect line because a "1" signal has been sent to the actuated keyswitch 3. Because the action has a "0" value, the select gate 18 will place a "0" in the latch 19 at the 4th bit position as directed by the value of the Inc=15. At this stage in the search sequence the latch 19 will contain the keyswitch identification code word of 000---.

In response to the "1" state on the signal detect line, the adder 11 will be incremented to the state 3 in the manner previously described.

The 4th word in Table 1 is now read out of the keycode memory 12. Since switch 3 is actuated, a "1" will appear on the signal detect line. Because at this stage the action has a "0" value, the select gate 18 will place a "0" in the latch 19 at the 3rd bit position as directed by the value of the Inc=7. At this stage the latch 19 will contain 0000-- as the keyswitch identification code word.

In response to the "1" state on the signal detect line, the adder 11 will be incremented to the state 4 in the manner previously described.

The 5th word in Table 1 is now read out of the keycode memory 12. At this stage a "0" signal is sent to the actuated switch 3 so that a "0" signal will appear on the signal detect line. Therefore the select gate 18 will place a "0" in the latch 19 at 2nd bit position as directed by the value of the Inc=3. At this stage the latch 19 will contain 00000- as the keyswitch identification code.

In response to a "0" state on the signal detect line, the gate 22 will select the Inc value read out of the keycode memory 12 to be added to the state of the adder 11. Since at this stage the Inc=3, the adder 11 will be incremented to the state of 4+3=7.

The 9th word in Table 1 is now read out from the keycode memory 12. Because switch 3 is actuated, a "1" state signal will be transmitted to the signal detect line. At this step the action is a state "1" so that the AND-gate 17 transmits a "1" binary logic signal to the select gate 18. Therefore the select gate 18 places a "1" in the 2nd bit position of the latch 19 as directed by the value of the Inc=3. At this search stage the latch 19 will contain 00001- as the keyswitch identification code.

In response to the "1" state on the signal detect line, the adder 11 will be incremented to the state 9.

The 10th word in Table 1 is now read out from the keycode memory 12. Because switch 3 is actuated, a "1" state signal will be transmitted to the signal detect line. At this step the action is a state "1" so that the select gate 18 will place a "1" in the first bit position of the latch 19 as directed by the value of the Inc=1. At this step in the search sequence the latch will contain 000011 as the keyswitch identification code which correctly identifies keyswitch 3 as the actuated keyswitch.

In response to the value of Inc=1, the increment 21 causes the keyswitch identification code word to be transmitted via gate 20 to the utilization means 23.

The remainder of the steps in the search sequence which will identify switch 41 as the second actuated keyswitch as shown in Table 2. It should be noted that at step 23 the adder 11 is reset to a zero value because it is implemented as a modulo 126 adder. Thus a new search sequence will be initiated when this step is reached.

The function of the AND-gate 24 is to insure that gate 20 will only transfer the keyswitch identification code from latch 19 to the utilization means 23 if the Inc has the value one and if a "1" signal appears on the signal detect line.

Figure 8:
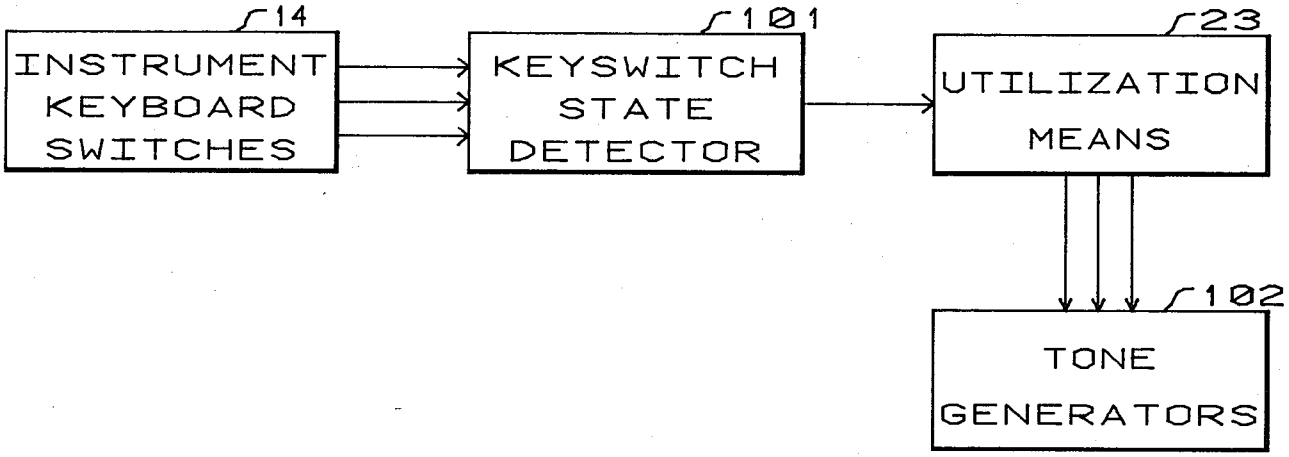
FIG. 8 is a schematic diagram of the invention incorporated into a musical instrument.

FIG. 8 illustrates a keyboard operated musical instrument incorporating the present invention.

Figure 4:
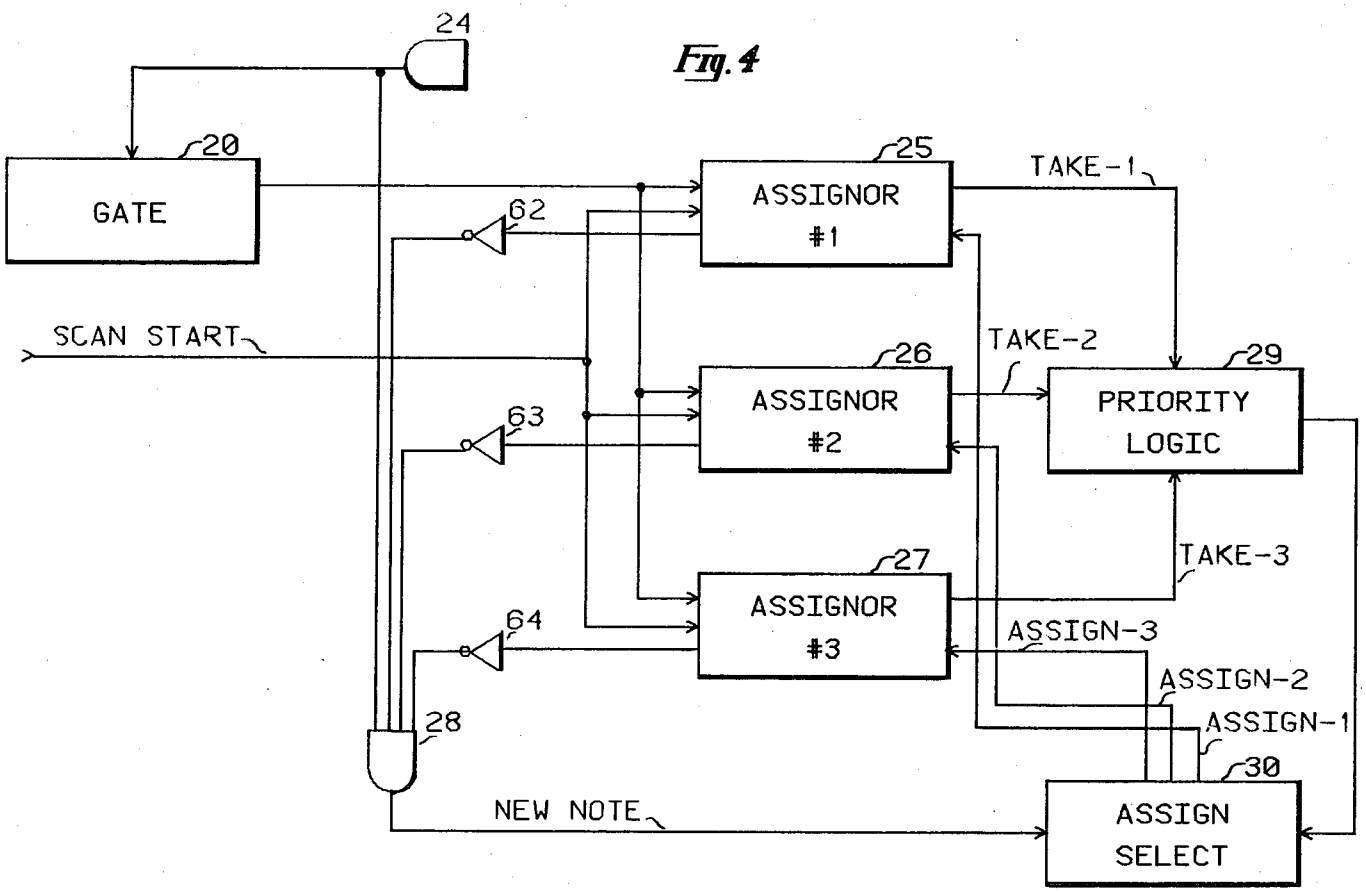
FIG. 4 is a schematic diagram of the utilization means 23.

FIG. 4 illustrates the details of a utilization means 23. This subsystem is used to assign musical tone generators contained in the box shown in FIG. 8 labeled tone generators 102 to actuated keyswitches in the keyboard switch array 14. While only three assignors are shown explicitly in FIG. 4, it is obvious from the following description that any number of assignors can be incorporated into the subsystem. It is a feature of the present invention that the assignors are modular units so that the same basic subsystem can be used to implement any number of assignors up to the number of keyswitches contained in the keyboard switch array 14.

Each of the assignors 25–27 contains a comparator. The detailed logic of the assignor units is described later. Each time that the gate 20 transmits a keyswitch identification code in response to the signal from the AND-gate 24, each of the assignors compares the transferred keyswitch identification code with a previous number that is stored in an assignor. If the new keyswitch identification code is not equal to the internally stored keyswitch identification code, a logic binary "1" signal is transmitted to the AND-gate 28. Thus the AND-gate 28 will only generate a NEW NOTE signal when a logic "1" is generated by the AND-gate 24 and when the keyswitch associated with a new switch actuation has not been previously assigned to any of the assignors 25–27.

Each of the assignors 25–27 sends a TAKE signal to the priority logic 29 in a manner described below. A TAKE signal will be a logic binary "1" signal if the associated assignor is still assigned to an actuated keyswitch. The task of the priority logic 29 is to decide which is the lowest numbered assignor which is not in an assigned state. Each of the assignors 25–27 is given a numerical label which is used to identify an assignor. The description number of the lowest numbered assignor which is not assigned is transferred from the priority logic 29 to the assign select 30. The assign select 30 will assign the keyswitch identification code to the lowest numbered assignor which is in its unassigned mode if the NEW NOTE signal is generated. If all the assignors have been assigned and a NEW NOTE signal is generated, the keyswitch identification code transmitted by the gate 20 is ignored.

Figure 5:
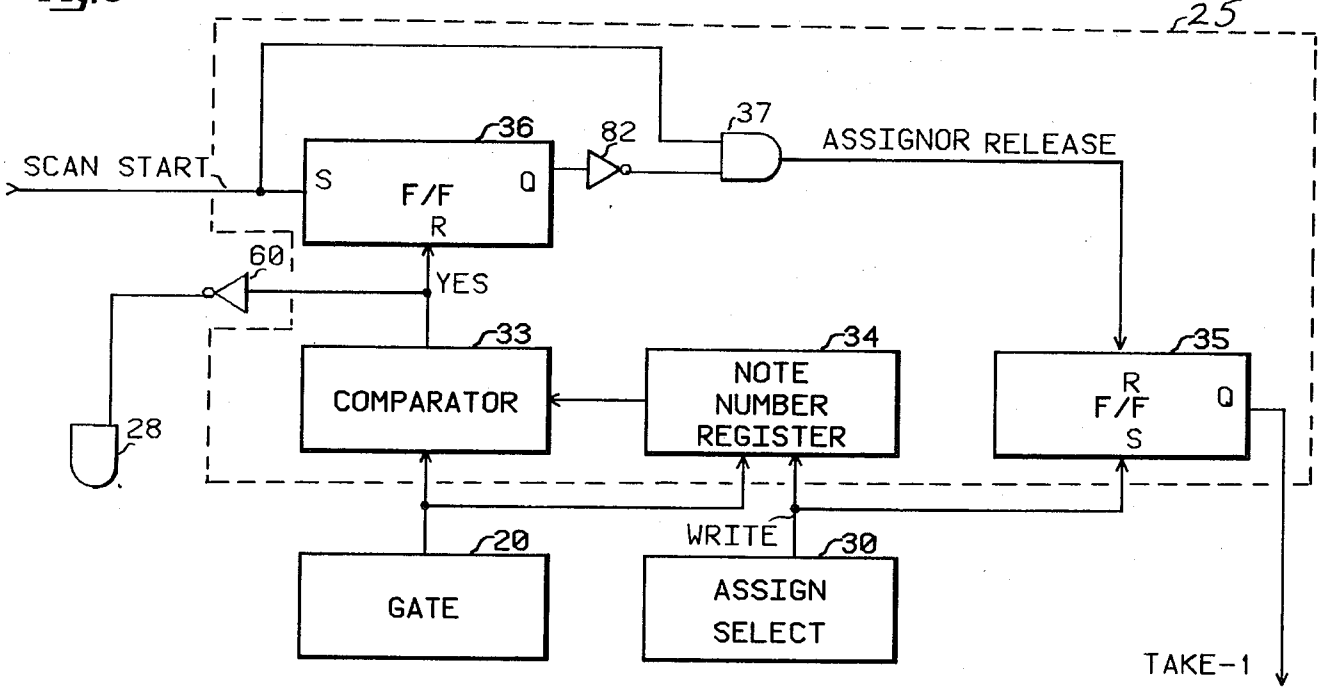
FIG. 5 is a schematic diagram of the assignor 25.

The detailed logic of the assignor #1 25 is shown in FIG. 5. To illustrate the operation of the assignor it is assumed that the operation starts in the condition that no assignment has been made. In the unassigned state the flip-flop 35 has been reset so that the signal TAKE-1 has a binary logic state of "1". The unassigned condition is one in which the flip-flop 36 has been set so that its output state is Q="1".

A new keyswitch is actuated. At the start of search sequence the SCANSTART signal will not alter the state of the flip-flop 36 which had been previously set. Each time that the comparator 33 compares the data previously stored in the note number register 34 with the keyswitch identification code transferred by the gate 20, no equality will be found in the comparison. A "0" state will be generated by the comparator 33 if there is no equality in the comparison. The "0" state is inverted into a "1" state by the inverter 60 and then it is sent to the AND-gate 28.

At some stage during the search sequence the system will find that a new keyswitch closure has been detected because each of the assignors will each have sent a "1" state signal to the AND-gate 28. At this stage the NEW NOTE signal will be generated by the AND-gate 28. In a manner described below, it is assumed that the priority logic decides that the assignor #1 25 is the lowest numbered assignor which is presently unassigned.

The assign select 30 will generate a WRITE signal which is transmitted to the note number register 34. In response to the WRITE signal the note number register 34 will store the keyswitch identification code transferred by the gate 20 which corresponds to the newly actuated keyswitch in the keyboard switch array 14. The WRITE signal will also set the flip-flop 35 so that the signal TAKE-1 is a logic "1" state to indicate that assignor #25 is now in its assigned state.

The next case to consider is the action that occurs during a search sequence during which the keyswitch assigned to assignor #1 25 remains in its actuated state. Because the flip-flop 36 is still in its set condition, the SCAN START signal generated at the start of a search sequence will not change the current state of the flip-flop 35. At some stage in the search sequence the comparator 33 will find an equality match between the data value stored in the note number register 34 and the keyswitch identification code transferred by the gate 20. When an equality is found the YES signal will be generated as a "1" binary logic state.

The "1" signal state for the YES signal resets the flip-flop 36 so that its output logic state is Q="0" and the corresponding input signal to the AND-gate 37 is a logic "1" state. Since this reset of the flip-flop does not occur simultaneously with the generation of the SCAN START signal, no change is made in the state of the flip-flop 35 at this time.

For the next search sequence, assuming that the assigned keyswitch remains actuated, the SCAN START signal sets the flip-flop 36 at the start of the sequence. The AND-gate 37 will not generate a "1" output logic state because the YES="1" signal and the SCAN START="1" signal do not occur simultaneously. The net result is that the flip-flop 36 will toggle between its two states with no effect on the remainder of the system logic. Under these conditions the flip-flop 36 will always be in its reset state at the end of a search sequence.

The last case to consider is that for the search sequence that starts immediately following the release (unactuated state) of the keyswitch that had been assigned to the assignor #1 25. At the end of this search sequence the flip-flop 36 is not reset because the YES="1" signal is not generated by the comparator 33 because the assigned keyswitch is no longer actuated. At the start of the next search sequence the state of the flip-flop remains at Q="0" so that the SCAN START="1" signal causes the AND-gate 37 to generate the ASSIGNOR RELEASE signal. The generation of the ASSIGNOR RELEASE signal will reset the flip-flop 35 so that its output is TAKE-1="0". The TAKE-1="0" signal indicates that the assignor #1 25 has been released and its in its unassigned state.

The states of the TAKE-1 can be used to initiate and terminate an ADSR (attack/decay/sustain/release) envelope generator which is used to apply the transient envelope modulations to a musical tone created by a tone generator associated with an assignor subsystem. The keyswitch identification code stored in the note number register 34 can be used to assign a musical frequency to a musical tone generator.

A system for using keyswitch identification code number for controlling the frequency of a musical tone generator is described in U.S. Pat. No. 4,114,496 entitled "Note Frequency Generator For A Polyphonic Tone Generator." This patent is hereby incorporated by by reference.

A system for generating an envelope ADSR modulation function in response to a control signal, such as the TAKE-1 signal, is described in U.S. Pat. No. 4,079,650 entitled "ADSR Envelope Generator." This patent is hereby incorporated by reference.

While the tone generators and ADSR envelopes are not shown explicitly in FIG. 4, they are implemented as subsystems contained in each of the assignors.

Figure 6:
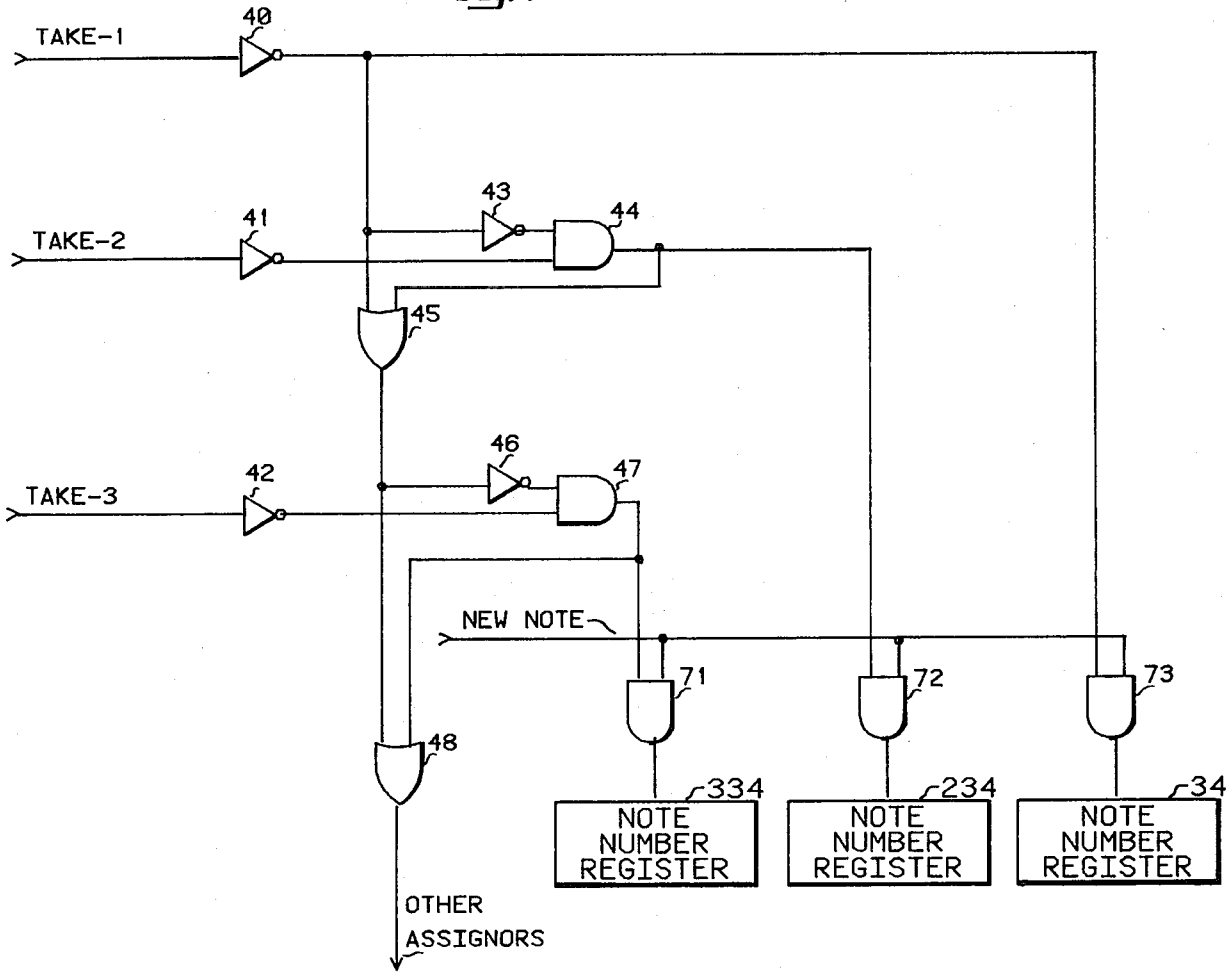
FIG. 6 is a schematic diagram of the priority logic 29.

The details of the priority logic are shown in FIG. 6. To illustrate the operation of the logic, consider the case in which TAKE-1="1", TAKE-2="0", and TAKE-3="0". In this case the inverter 40 will transmit a "0" logic state signal ot the assign select 30 which indicates that assignor #1 is presently in its assigned state.

In response to the "0" output from the inverter 40, the inverter 43 sends a "1" signal to one input of the AND-gate 44. Since TAKE-2="0", the inverter 41 also sends a "1" signal to the other input to the AND-gate 44. Therefore the AND-gate 44 generates a "1" signal which is sent to the assign select to indicate that an assignment can be made to the assignor #2.

The OR-gate 45 will transfer a "1" state to the inverter 46 and the OR-gate 48. Since the AND-gate 47 receives a "0" state on one of its input lines connected to the inverter 46, a "0" state signal is generated by the AND-gate 47. This "0" signal is sent to the assign select 30 to indicate that either assignor #3 is currently assigned or that assigned state should be ignored because it has already been determined that assignor #2 is the lowest numbered assignor which is unassigned. Note that if all the assignors have been assigned then the output from the OR-gate 48 is a "0" binary logic state which denotes the condition that all the assignors are in their assigned state.

The assign select 30 can be implemented by the means of the set of AND-gates shown in FIG. 6. When the NEW NOTE signal is generated a "1" binary logic state signal will be sent to the note number register of an assignor corresponding to the AND-gate in the set 71–73 that has its second input at a "1" state indicating that the corresponding assignor has been found to be unassigned by the priority logic.

Figure 7:
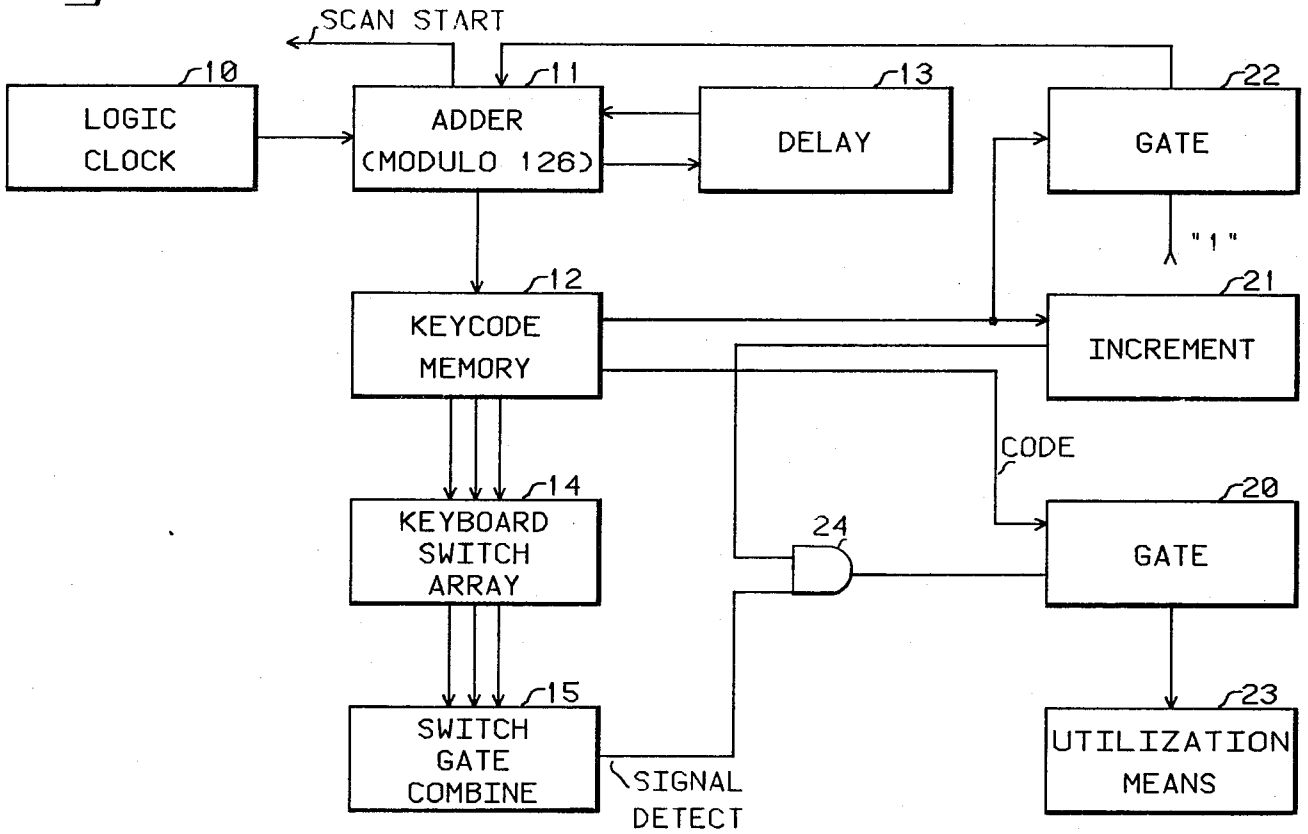
FIG. 7 is a schematic diagram of an alternate embodiment of the invention.

An alternate version of the present invention is shown in FIG. 7. This version eliminates the logic employed in the system shown in FIG. 1 which incorporated a subsystem for bit-by-bit encoding of the keyswitching identification. In the alternate implementation the select gate 18, latch 19 and the ACTION signal used in the version shown in FIG. 1 are eliminated. The bit-by-bit encoding of the keyswitch identification code is replaced by storing these codes in the keycode memory 12. In Table 1, for each word shown having only a single "1" state for a switch signal, the corresponding keyswitch identification code is stored instead of the ACTION signal shown in the table. When the output of the increment 21 is a "1" state and a "1" also exists on the signal detect line, the gate 20 transmits the keyswitch identification code read out of the keycode memory to the utilization means.

We claim:

1. In combination with a keyboard operated musical instrument comprising a keyboard array of a number of keyswitches and having a plurality of musical tone generators, apparatus for assigning members of said plurality of musical tone generators to actuated keyswitches comprising:

a search sequence means responsive to an advance signal whereby a search signal is applied to selected subsets of said array of keyswitches wherein said selected subsets are chosen in a prespecified binary search tree search arrangement and whereby a detect signal is generated by each member of said selected subset of keyswitches which is in its actuated keyswitch state, a sequence advance means whereby said advance signal is generated in response to said detect signals generated by members of said selected subset of keyswitches which are in their actuated keyswitch states, an encoding means responsive to said advance signal and to said detect signals whereby a keyswitch indentification code word is generated for each actuated keyswitch in said array of keyswitches, and a utilization means responsive to each said keyswitch identification code word whereby one of said plurality of musical tone generators is assigned to produce a musical tone associated with its corresponding actuated keyswitch.

2. In a musical instrument according to claim 1 wherein said search sequence means comprises;

a keycode search word generator responsive to said advance signal whereby a keycode search word is generated in a binary numerical format, and a keyswitch addressing means whereby each binary bit of said keycode search word is connected to a corresponding one of said keyswitches in said keyboard array of keyswitches thereby causing said detect signal to be generated by any of said keyswitches which is in its actuated state and its associated said binary bit is in a cone binary logic state.

3. In a musical instrument according to claim 2 wherein said keycode search word generator comprises an addressable memory for storing a plurality of keycode search words corresponding to the number of keyswitches in said array of keyswitches.

4. In combination with a keyboard operated musical instrument comprising a keyboard array of a number of keyswitches and having a plurality of musical tone generators, apparatus for assigning members of said plurality of musical tone generators to actuated keyswitches comprising;

a keycode search word generator responsive to a sequence of advance signals whereby keycode search words are encoded to provide a binary tree search for actuated keyswitches in said array of key switches, a search sequence means whereby said keycode search words are applied to keyswitches in a selected subset of said array of keyswitches thereby causing a detect signal to be generated by members of said selected subset of keyswitches which are in their actuated keyswitch state, a sequence advance means whereby said sequence of advance signals is generated in resonse to said detect signals, an encoding means responsive to said sequence of advance signals and to said detect signals whereby a keyswitch identification code word is generated for each actuated keyswitch in said array of keyswitches, and a utilization means responsive to each said keyswitch identification code word whereby one of said plurality of musical tone generators is assigned to produce a musical tone associated with its corresponding actuated keyswitch.

5. In a musical instrument according to claim 4 wherein said sequence advance means comprises;

a timing clock means for providing clock signals, an adder means for adding an increment word to a search word contained in said adder means and whereby in response to said clock signals said search word is read out to provide said advance signal, and an increment word generator whereby said increment word is created with a one numerical value if said detect signal is generated and whereby said increment word is generated with a numerical value contained in said advance signal if no said detect signal is generated.

6. in a musical instrument according to claim 5 wherein said adder means adds said increment word to said search word modulo a prespecified number corresponding to the number of keyswitches in said keyboard array of keyswitches and wherein a scan start signal is generated when said search word is reset to its minimal value.

7. In a musical instrument according to claim 4 wherein said utilization means comprises;

a plurality of assignor means each of which corresponds to one of said plurality of musical tone generators and wherein each one of said assignor means stores a value of said keyswitch identification code word, a new signal detect means whereby a new assignment signal is generated if said keyswitch identification code word generated by said encoding means does not correspond to any keyswitch identification code word stored in said plurality of assignor means, and a priority assign means responsive to said new assignment signal for storing said keyswitch identification code word generated by said encoding means in a selected one of said plurality of assignor means.

8. In a musical instrument according to claim 7 wherein each one of said plurality of assignor means comprises;

a note number memory means, responsive to said priority means, for storing said keyswitch identification code word generated by said encoding means, a comparator means whereby an equal signal is generated if said keyswitch identification code word stored in said note number memory means is equal to said keyswitch identification code word generated by said encoding means, and an assignment state means responsive to said scan start signal wherein an assigned state signal is created in response to said equal signal.

9. In a musical instrument according to claim 8 wherein said new signal detect means generates said new assigned signal if none of the comparators in each of said plurality of assignor means generates said equal signal.

10. In a musical instrument according to claim 9 wherein said priority assign means comprises;

priority select logic responsive to each of said assigned state signals created by said plurality of assignor means whereby in response to said new assignment signal said keyswitch identification code word generated by said encoding means is stored in a selected one of said assignor means where said selection is made by a preselected priority criterion.

11. In combination with a keyboard operated instrument comprising an array of a number of keyswitches and having a plurality of utilization means, apparatus for assigning members of said plurality of utilization means to actuated keyswitches comprising;

a binary-tree search sequence generator means responsive to an advance signal whereby a binary-tree search signal is applied to each keyswitch in a selected subset of said array of keyswitches and whereby a set of detect signals is generated by keyswitches in said subset of keyswitches which are in their actuated keyswitch states, a sequence advance means whereby said advance signal is generated in response to said set of detect signals, an encoding means responsive to said advance signal and to said set of detect signals whereby a keyswitch identification code word is generated which identifies each actuated keyswitch in said array of keyswitches, and an assignor means, responsive to each said keyswitch identification code word, whereby members of said plurality of utilization means are assigned to actuated keyswitches in said array of keyswitches.

12. In a keyboard operated instrument according to claim 11 wherein each of said plurality of utilization means comprises a musical tone generator.

* * * * *